United States Patent [19]

Filer

[11] Patent Number: 4,611,852

[45] Date of Patent: Sep. 16, 1986

[54] BLEACHER BACK-REST

[76] Inventor: Paul G. Filer, Rt. #2, Box 199, Vandalia, Ill. 62471

[21] Appl. No.: 713,321

[22] Filed: Oct. 25, 1984

[51] Int. Cl.[4] ..... A47C 15/00

[52] U.S. Cl. ..... 297/352; 297/252; 297/440; 297/443

[58] Field of Search ..... 297/352, 252, 443, 440

[56] References Cited

U.S. PATENT DOCUMENTS

| | | | |
|---|---|---|---|
| 475,083 | 5/1892 | Huber | 297/443 |
| 882,316 | 3/1908 | Horton | 297/443 X |
| 1,408,114 | 2/1922 | Mathieu | 297/443 |
| 1,461,772 | 7/1923 | Fuller | 297/352 |
| 2,189,520 | 2/1940 | Inzerillo | 297/352 |
| 2,710,646 | 6/1955 | Kirby | 297/352 X |
| 2,797,740 | 7/1957 | Cappello | 297/443 X |
| 4,068,889 | 1/1978 | Pierce et al. | 297/352 |

*Primary Examiner*—Francis K. Zugel

[57] ABSTRACT

A seat structure comprised of rigid molded plastic parts and the like interconnecting to form a back-rest for use upon bleachers and the like, subsequently interconnecting for carrying. The back portion is molded in a form possessing tongues that insert through slots in the seat portion wherein the said back portion is anchored into and supported by the said seat portion. A stabilizer in the form of a channel shaped molded plastic part is attached to the underside of the said seat portion anchoring the said back-rest. In transport the tongues of the said back portion insert through the slots of the said seat portion on the opposite side. A transverse slot in the said stabilizer receives the upper portion of the said back portion securing the said seat and back portions in a vertical carrying position.

1 Claim, 3 Drawing Figures

BLEACHER BACK-REST

REFERENCES CITED

| U.S. PAT. DOCUMENTS | | |
|---|---|---|
| 3,359,036 8/1966 Druth and Notko | | 297/352 |
| 4,079,993 8/1976 Pierce | | 297/352 |
| 4,385,782 5/1983 Clark, Jr. | | 297/352 |

SUMMARY

A seat structure comprised of rigid plastic parts and the like for use upon bleachers commonly found at sporting events and the like. The important objects of the invention are to provide a durable and adaptable bleacher back-rest as a result of a practical, efficient and economical means of manufacture thereof. The three main parts consist of plastic and the like molded and slotted in such a manner as to interconnect to form a bleacher back-rest and subsequently interconnecting for carrying.

BRIEF DESCRIPTION OF THE DRAWINGS

FIG. 1 is a perspective view illustrating the back-rest fully assembled, as it would appear upon a bleacher and the like.

DESCRIPTION OF THE PREFERRED EMBODIMENT

Figure 1:
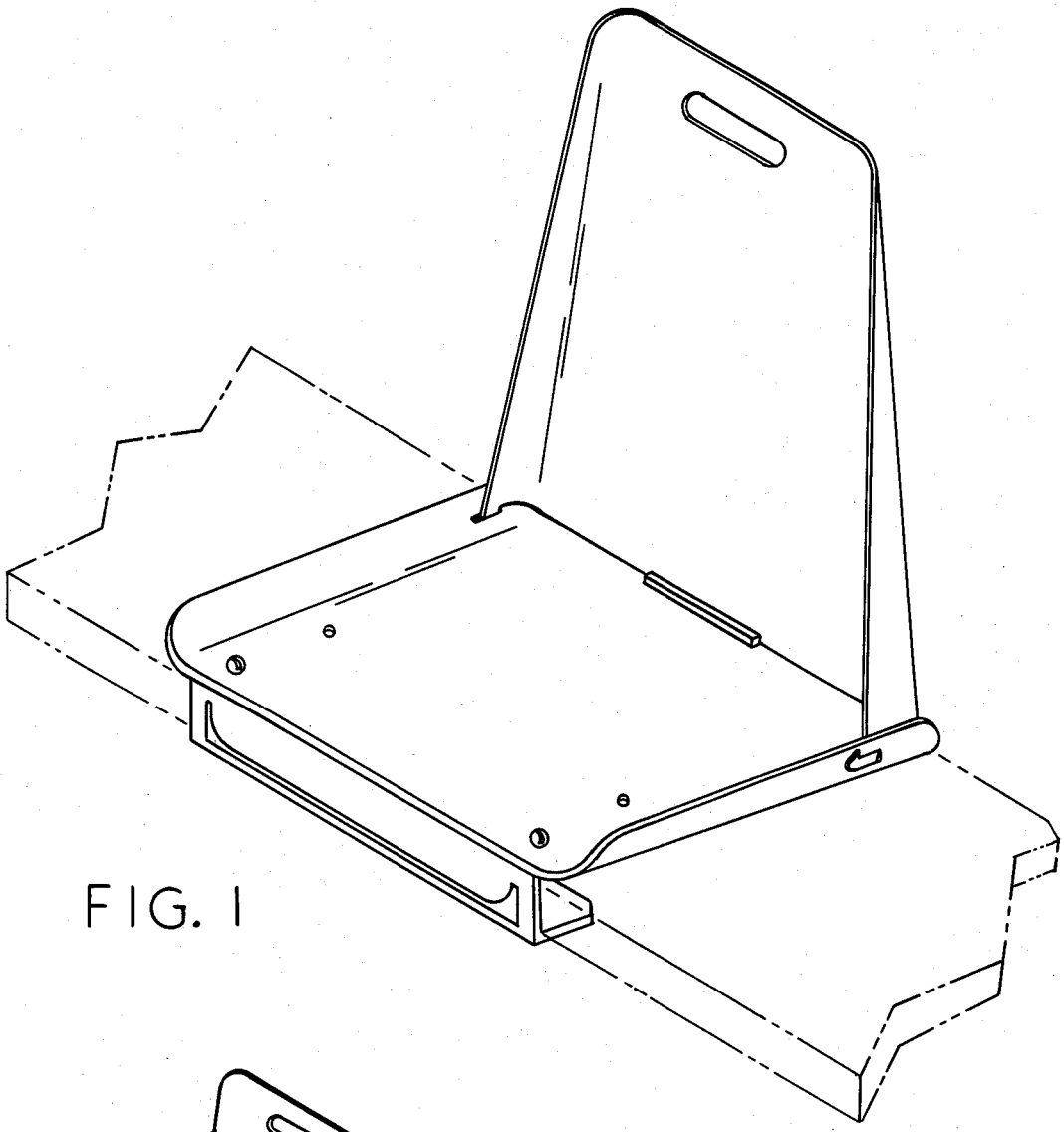
Figure 2:
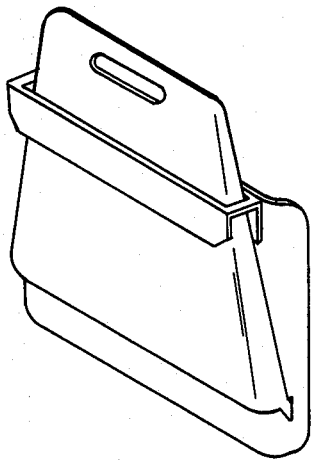
FIG. 2 is a perspective view illustrating the back-rest fully assembled, as it would appear in transport.
Figure 3:
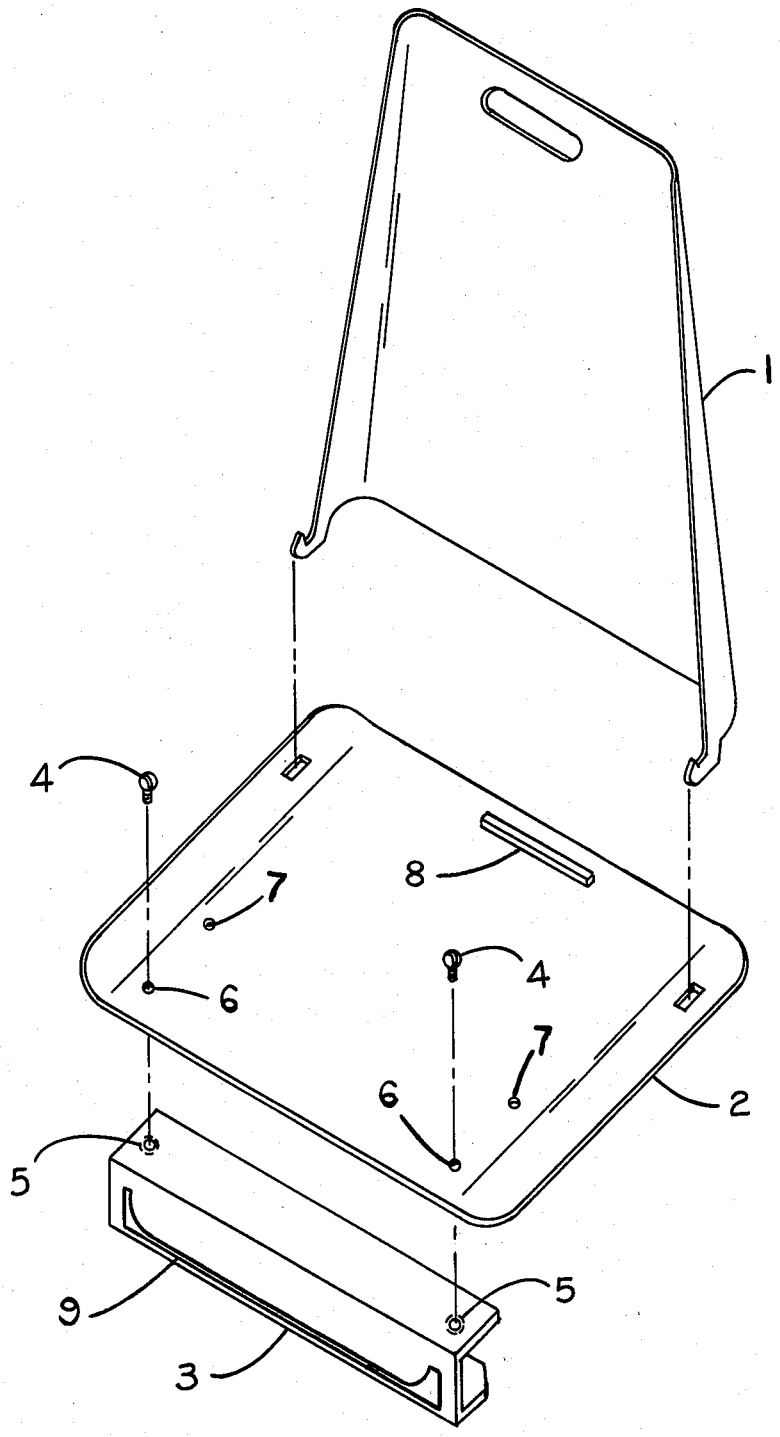
FIG. 3 is a perspective view illustrating the parts that makeup the back-rest.

The drawings FIG. 3 illustrate interconnecting plastic molded parts and the like forming a back-rest for use upon bleachers and the like. The back portion 1 consists of sheet plastic and the like curved frontward along the side perimeters. Tongues on either side of the said back portion extend down and frontward inserting through corresonding slots in the seat portion 2. The said seat portion 2 consists of sheet plastic and the like curved upward along the side perimeters. Two pairs of holes 6 and 7 in the said seat portion 2 allow the stabilizer 3 to be attached to the front 6 for use on wide bleachers and somewhat recessed 7 for use on bleachers of narrow width. The said stabilizer is fastened with screws 4 and threaded inserts 5 and the like. A stop 8 restricts the force exerted by a user leaning back. A transverse slot 9 in the said stabilizer 3 receives the upper portion of the said back portion when in transport FIG. 2. The tongues of the said back portion 1 insert through the slots of the said seat portion on the opposite side FIG. 2 when in transport.

I claim:

1. A molded seat structure comprised of three main parts; the back formed of sheet material substantially rectangular possessing tongues that extend down and frontward; the bottom formed of sheet material substantially rectangular possessing slots that correspond with the said tongues of the said back interlocking to accomodate the said tongues of the said back thereby conecting to form a seat and back structure; the third main part depending from the front of the said seat acts as an anchor securing the said structure to bleachers and the like; the transverse slot in the said anchor receives the upper portion of the said back; the said tongues of the said back insert through the said corresponding slots of the said seat inter-connecting the parts in a vertical knock down carrying position.

* * * * *